US010507852B2

(12) United States Patent
Schmidt et al.

(10) Patent No.: US 10,507,852 B2
(45) Date of Patent: Dec. 17, 2019

(54) WARM OR HOT STANDBY TRACK CARD MODULE FOR USE ON A WAYSIDE OF A RAILWAY SYSTEM

(71) Applicant: Siemens Industry, Inc., Alpharetta, GA (US)

(72) Inventors: Holger Schmidt, Saint Johns, FL (US); Brian Joseph Hogan, Temecula, CA (US)

(73) Assignee: SIEMENS MOBILITY, INC., New York, NY (US)

( * ) Notice: Subject to any disclaimer, the term of this patent is extended or adjusted under 35 U.S.C. 154(b) by 345 days.

(21) Appl. No.: 15/458,060

(22) Filed: Mar. 14, 2017

(65) Prior Publication Data

US 2018/0265104 A1 Sep. 20, 2018

(51) Int. Cl.

*B61L 1/18* (2006.01)
*B61L 27/00* (2006.01)
*B61L 25/02* (2006.01)

(52) U.S. Cl.

CPC ..... *B61L 1/181* (2013.01); *B61L 1/188* (2013.01); *B61L 25/02* (2013.01); *B61L 27/0066* (2013.01)

(58) Field of Classification Search

CPC ..... B61L 1/18; B61L 1/181; B61L 1/188
See application file for complete search history.

(56) References Cited

U.S. PATENT DOCUMENTS

| | | | | |
|---|---|---|---|---|
| 4,763,267 | A | 8/1988 | Knight et al. | |
| 6,494,409 | B1 * | 12/2002 | Franke | B61L 1/181 246/34 B |
| 2006/0060724 | A1 * | 3/2006 | Francis | B61L 1/18 246/122 R |
| 2008/0296441 | A1 * | 12/2008 | Anderson | B61L 1/185 246/121 |
| 2015/0307117 | A1 * | 10/2015 | Noffsinger | B61L 23/044 246/121 |
| 2016/0090113 | A1 * | 3/2016 | Nagrodsky | B61L 23/04 246/34 R |
| 2018/0093684 | A1 * | 4/2018 | Nagrodsky | B61L 5/06 |
| 2018/0265104 | A1 * | 9/2018 | Schmidt | B61L 1/181 |
| 2018/0327008 | A1 * | 11/2018 | Kindt | B61L 1/18 |
| 2019/0168791 | A1 * | 6/2019 | Guislain | B61L 1/162 |

FOREIGN PATENT DOCUMENTS

CN 105353604 A 2/2016

* cited by examiner

*Primary Examiner* — Jason C Smith

(57) ABSTRACT

A coded track circuit of a signaling control equipment to be located at a wayside location of a railway track is provided. The coded track circuit comprises a first track circuit card coupled to rails of the railway track to detect an absence of a train on the railway track, inform signallers and control relevant signals via track codes. The coded track circuit further comprises a second track circuit card coupled to rails of the railway track, the second track circuit card is inactive but ready to provide a warm-standby or a hot-standby such that the second track circuit card to take over control from the first track circuit card should the first track circuit card fails.

19 Claims, 4 Drawing Sheets

WARM OR HOT STANDBY TRACK CARD MODULE FOR USE ON A WAYSIDE OF A RAILWAY SYSTEM

BACKGROUND

1. Field

Aspects of the present invention generally relate to signaling control at a wayside location of a railway track and more specifically relate to a track card that supports a selective redundancy as two track cards are connected to a same track on a wayside of a railway system.

2. Description of the Related Art

Most railroads use track circuits to determine which sections of a railway track are occupied by trains. Track circuits work by running a circuit using the rails to connect a power source at one end of the block with a relay at the far end. The relay and power source are connected to each rail by cables. As long as the circuit is complete, low voltage power flows down one rail, through a relay, and returns to the power source via the other rail. If the circuit is complete, the relay will be energized, which keeps signals in the "clear" position. If the circuit is broken, the system fails in a safe manner. A broken rail or a failed power source causes the relay to become de-energized and report the section of track as occupied.

Track circuit cards are connected directly to the rails of a railway track and therefore are susceptible to lightning and other sources for over-voltage. This creates a single point of failure for the signaling control equipment in a wayside location.

Current implementations of coded track circuit cards (Electrcode® or MIKROTRAX® compatible) do not support any standby concepts. There is a similar concept implemented for grade crossing equipment. However, the implementation in the GCP4000/5000 requires changeover to a complete redundant system that does not boot until activated (system 1 is operational→fails→change over to system 2→system 2 boots and takes over. This is a cold-standby concept that also requires a full second set of equipment.

Therefore, there is a need for a solution that survives a single point of failure for the signaling control equipment in a wayside location.

SUMMARY

Briefly described, aspects of the present invention relate to a track card that supports the selective redundancy concept of a railway system such that two track cards may be connected to the same track. It is understood that the inactive card will need to be insulated from the rails by means of an air-gap (relay). The inactive card will continually run online checks to verify that it is ready to take over control should the active card fails. The reception of established track codes will likely get lost for a brief moment (about 6 seconds in case of Electrcode®) but will pick up automatically afterwards. This is a warm-standby or a hot-standby concept.

In accordance with one illustrative embodiment of the present invention, a coded track circuit of a signaling control equipment to be located at a wayside location of a railway track is provided. The coded track circuit comprises a first track circuit card coupled to rails of the railway track to detect an absence of a train on the railway track, inform signallers and control relevant signals via track codes. The coded track circuit further comprises a second track circuit card coupled to rails of the railway track, the second track circuit card is inactive but ready to provide a warm-standby such that the second track circuit card to take over control from the first track circuit card should the first track circuit card fails.

In accordance with another illustrative embodiment of the present invention, a track circuit system for use at a wayside location of a railway track is provided. The track circuit system comprises a coded track circuit, a first track circuit card and a second track circuit card. The first track circuit card is coupled to rails of the railway track and coupled to the coded track circuit to detect an absence of a train on the railway track, inform signallers and control relevant signals via track codes. The second track circuit card is coupled to rails of the railway track and coupled to the coded track circuit to provide a warm-standby such that the second track circuit card to take over control from the first track circuit card should the first track circuit card fail.

In accordance with another illustrative embodiment of the present invention, a method of signaling control at a wayside location of a railway track is provided. The method comprises providing a coded track circuit, providing a first track circuit card coupled to rails of the railway track and coupled to the coded track circuit to detect an absence of a train on the railway track, inform signallers and control relevant signals via track codes and providing a second track circuit card coupled to rails of the railway track and coupled to the coded track circuit to provide a warm-standby such that the second track circuit card to take over control from the first track circuit card should the first track circuit card fail.

DETAILED DESCRIPTION

To facilitate an understanding of embodiments, principles, and features of the present invention, they are explained hereinafter with reference to implementation in illustrative embodiments. In particular, they are described in the context of being a warm-standby or hot-standby track circuit module. For example, the warm-standby or hot-standby track circuit module provides a selective redundancy as two track cards are connected to a same track on a wayside of a railway system. Warm-standby is a method of redundancy in which the secondary (i.e., backup) system runs in the background of the primary system. Data is mirrored to the secondary server at regular intervals. Hot-standby is a method of redundancy in which the primary and secondary (i.e., backup) systems run simultaneously. The data is mirrored to the secondary server in real time so that both systems contain identical information. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
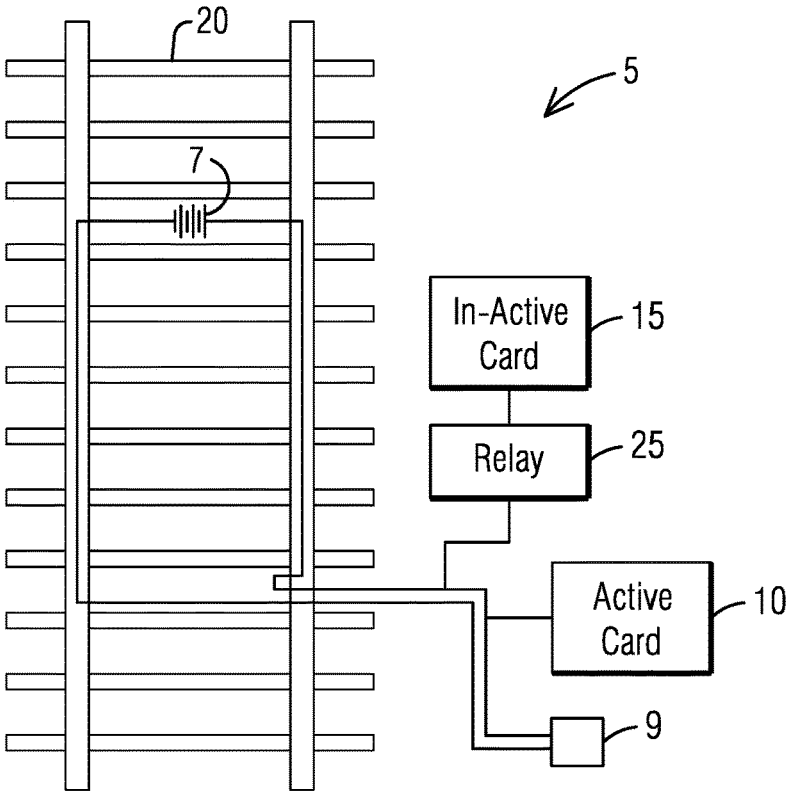
FIG. 1 illustrates a schematic block diagram of an unoccupied track circuit in accordance with an exemplary embodiment of the present invention.

Consistent with one embodiment of the present invention, FIG. 1 represents a schematic block diagram of an unoccupied track circuit 5 in accordance with an exemplary embodiment of the present invention. The unoccupied track circuit 5 works by running a circuit using the rails to connect a power source 7 at one end of the block with a relay 9 at the far end. The relay 9 and the power source 7 are connected to each rail by cables. As long as unoccupied track circuit 5 is complete, low voltage power flows down one rail, through the relay 9, and returns to the power source 7 via the other rail. If the unoccupied track circuit 5 is complete, the relay 9 will be energized, which keeps signals in the "clear" position. If the unoccupied track circuit 5 is broken, the system fails in a safe manner. A broken rail or a failed power source causes the relay 9 to become de-energized and report the section of track as occupied.

In one embodiment, a track circuit system includes an active card 10 and an inactive card 15 that may be connected to a same track 20. The inactive card 15 is insulated from the rails by means of an air-gap (relay) 25. The inactive card 15 continually runs online checks to verify that it is ready to take over control should the active card 10 fail. In this way, the inactive card 15 provides is a warm standby concept.

As used herein, "an inactive card or module" refers to a track circuit card or module configured to support an automatic selective redundancy in response to a failure or a malfunction of an active card. As used herein, "a warm-standby concept" refers to a warm-standby or a hot-standby as opposed to a cold standby that requires a boot. The "inactive card or module," in addition to the exemplary hardware description above, refers to a system that is configured to provide a driver circuit to operate a relay device. The driver circuit can include control electronics and multiple interacting devices, whether located together or apart, that together perform processes as described herein. The "inactive card or module" may be a single rail type or a double rail type. In a single rail type, traction return current passes through one rail only. In a double rail type, traction return current passes through both rails of the track circuit.

The techniques described herein can be particularly useful for using a relay-based track circuit card or module. While particular embodiments are described in terms of a relay-based track circuit card or module, the techniques described herein are not limited to the relay-based track circuit card or module but can also use other mechanisms such as other broadcast and communication devices.

Figure 2:
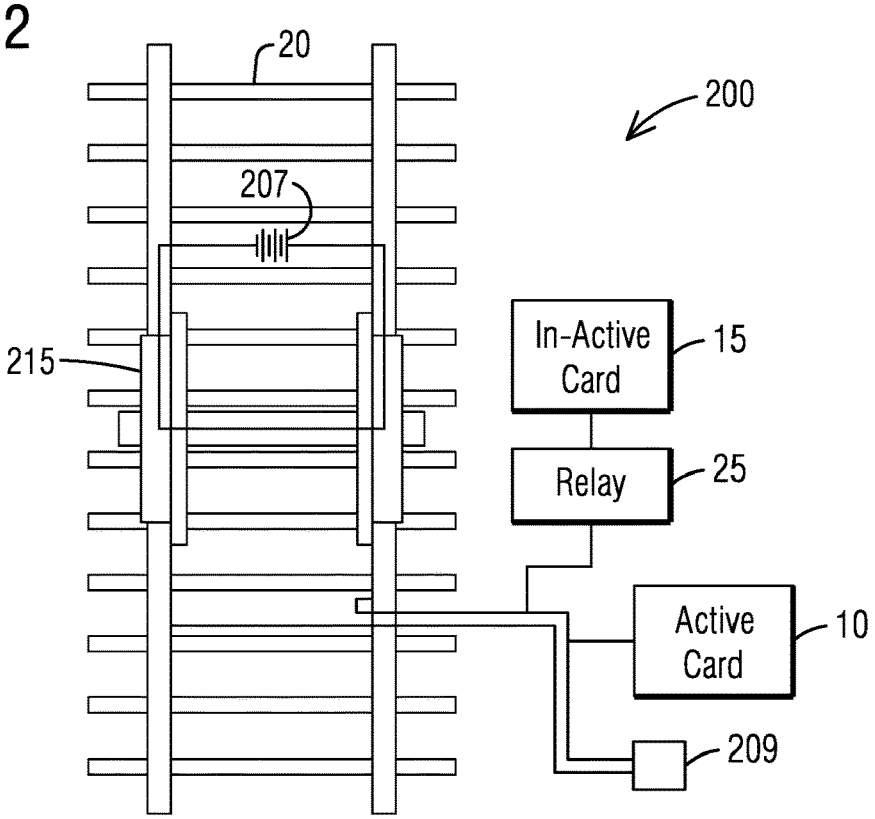
FIG. 2 illustrates a schematic block diagram of an occupied track circuit in accordance with an exemplary embodiment of the present invention.

Referring to FIG. 2, it illustrates a schematic block diagram of an occupied track circuit 200 in accordance with an exemplary embodiment of the present invention. The occupied track circuit 200 works by running a circuit using the rails to connect a power source 207 at one end of the block with a relay 209 at the far end.

A train is detected because it shorts the occupied track circuit 200. In railroading, this is called "shunting" the occupied track circuit 200. When a train enters a block, metal wheels and axle 215 conduct the occupied track circuit 200 as a short cut which bypasses the relay 209. This de-energizes the relay 209, which causes signals to report the block as occupied. Two track cards 10, 15 may be connected to the same track 20 and the in-active track card 15 supports a selective redundancy concept of a railway system.

Figure 3:
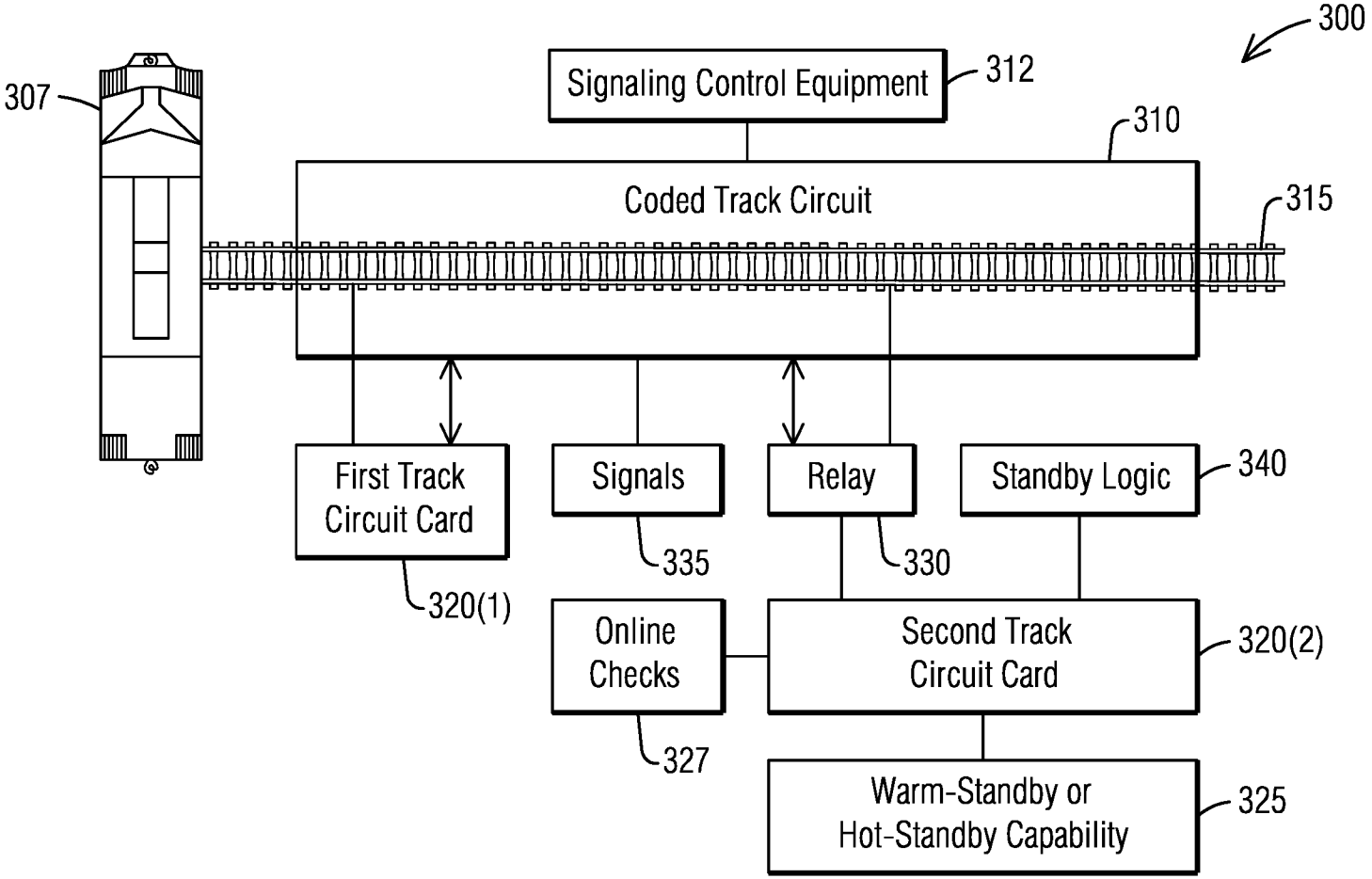
FIG. 3 illustrates a schematic block diagram of a track circuit system in accordance with another exemplary embodiment of the present invention.

Turning now to FIG. 3, it illustrates a schematic block diagram of a track circuit system 300 in accordance with another exemplary embodiment of the present invention. In order for the track circuit system 300 to work, a railway track 315 is divided into blocks of varying length. Each block is divided from the adjacent blocks by an insulated joint between rails. Blocks often have signals at each end to control train movements. Signals are transmitted to the cab of a train 322, and are not present next to the tracks except at switches. Each block has a coded track circuit 310 which determines whether the train 322 is present.

The track circuit system 300 includes the coded track circuit 310 of a signaling control equipment 312 located at a wayside location of the railway track 315. The coded track circuit 310 comprises a first track circuit card 320(1) coupled to rails of the railway track 315 to detect an absence of the train 322 on the railway track 315, inform signallers and control relevant signals via track codes. The coded track circuit 310 further comprises a second track circuit card 320(2) coupled to rails of the railway track 315. The second track circuit card 320(2) is inactive but ready to provide a warm-standby or a hot-standby capability 325 such that the second track circuit card 320(2) to take over control from the first track circuit card 320(1) should the first track circuit card 320(1) fails.

The second track circuit card 320(2) will continually run online checks 327 to verify that the second track circuit card 320(2) is ready to take over control. The second track circuit card 320(2) is insulated from the rails of the railway track 315 by means of an air-gap provided by a relay 330.

In operation, the first track circuit card 320(1) transmits and receives signals 335 on the coded track circuit 310 for the purposes of communicating with the second track circuit card 320(2) on the coded track circuit 310. The first track circuit card 320(1) determines a presence of the train 322 via a shunting action of train axles based on received signal levels (see FIG. 2 for details).

The coded track circuit 310 further comprises a standby logic 340 to control the warm-standby or hot-standby capability 325 to achieve redundancy of operation of a track module or card. The second track circuit card 320(2) to provide the warm-standby or hot-standby capability 325 in an event the first track circuit card 320(1) malfunctions.

Figure 4:
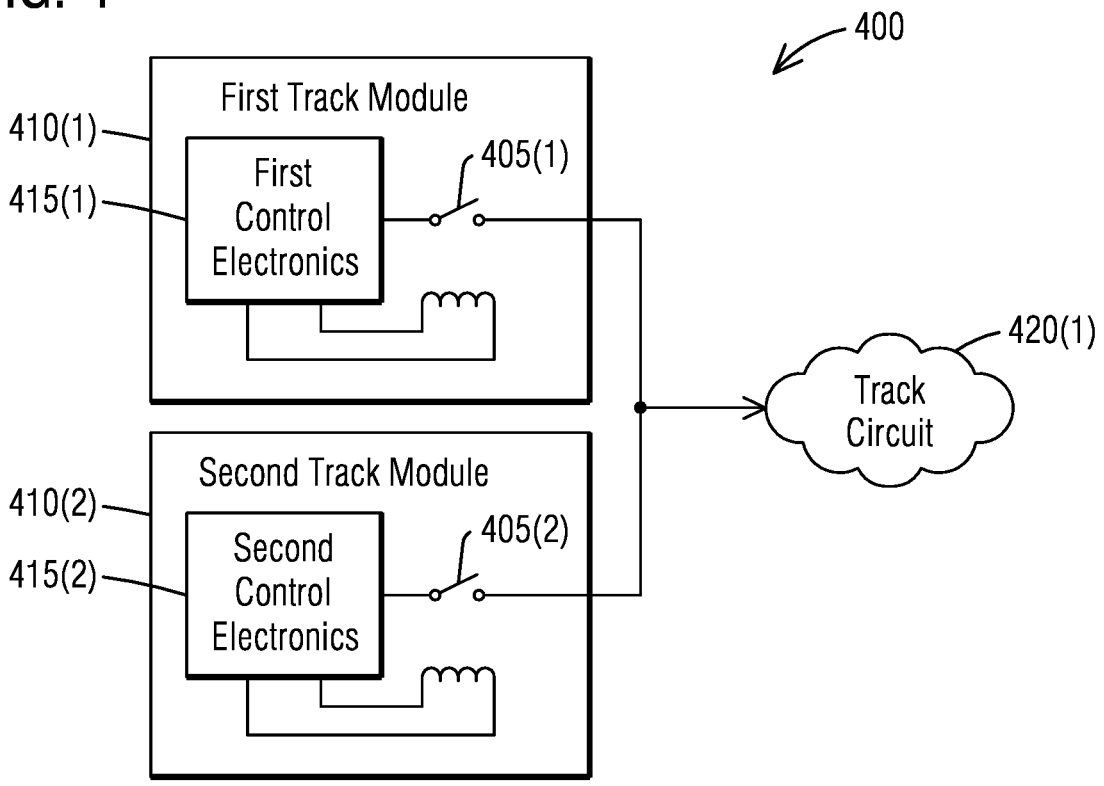
FIG. 4 illustrates a schematic block diagram of a track circuit system with internal relays in accordance with another exemplary embodiment of the present invention.

FIG. 4 illustrates a schematic block diagram of a track circuit system 400 with first and second internal relays 405(1-2) in accordance with another exemplary embodiment of the present invention. The track circuit system 400 comprises a first track module 410(1) and a second track module 410(2). The track circuit system 400 comprises a first coded track circuit 420(1). A track circuit has mainly two ends i.e. a feed end and a relay end.

Through the first coded track circuit 420(1) power is applied to each rail and a relay coil 405(1) wired across them. When no train is present, the relay coil 405(1) is energized by the current flowing from a power source through the rails. When a train is present, its axles short (shunt) the rails together; the current to the track relay coil 405(1) drops, and it is de-energized. Circuits through the relay contacts therefore report whether or not the track is occupied.

The first track module 410(1) includes a first control electronics 415(1) coupled to the first internal relay 405(1). The second track module 410(2) includes a second control electronics 415(2) coupled to the second internal relay 405(2). The first and the second internal relays 405(1-2) are coupled to the first coded track circuit 420(1).

The first control electronics 415(1) and the second control electronics 415(2) may be implemented via a processor or microprocessor in combination with some storage such as flash memory.

The first internal relay 405(1) being internal to the first track module 410(1) interfaces the first track module 410(1) to the first coded track circuit 420(1). The second internal relay 405(2) being internal to the second track module 410(2) interfaces the second track module 410(2) to the coded track circuit.

Figure 5:
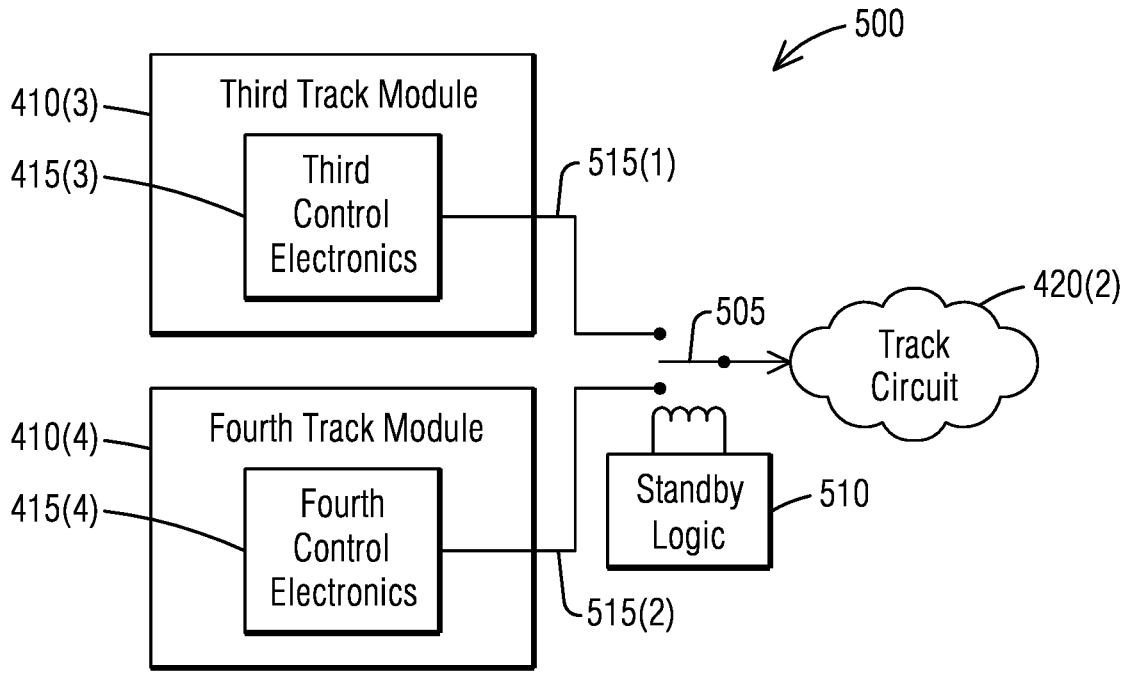
FIG. 5 illustrates a schematic block diagram of a track circuit system with an external relay in accordance with another exemplary embodiment of the present invention.

As seen in FIG. 5, it illustrates a schematic block diagram of a track circuit system 500 with an external relay 505 in accordance with another exemplary embodiment of the present invention. The track circuit system 500 comprises a third track module 410(3) and a fourth track module 410(4). The third track module 410(3) includes a third control electronics 415(3). The fourth track module 410(4) includes a fourth control electronics 415(4). The track circuit system 500 comprises a second coded track circuit 420(2).

The third control electronics 415(3) and the fourth control electronics 415(4) may be implemented via a processor or microprocessor in combination with some storage such as flash memory.

The track circuit system 500 further comprises a standby logic 510 to control a standby capability to achieve redundancy. The third track module 410(3) includes a first output connection 515(1). The fourth track module 410(4) includes a second output connection 515(2). The external relay 505 is connected to the third track module 410(3) and the fourth track module 410(4) such that the first output connection 515(1) and the second output connection 515(2) are in parallel.

The standby logic 510 is coupled to the external relay 505. The standby logic 510 may be implemented via a processor or microprocessor in combination with some storage such as flash memory.

Figure 6:
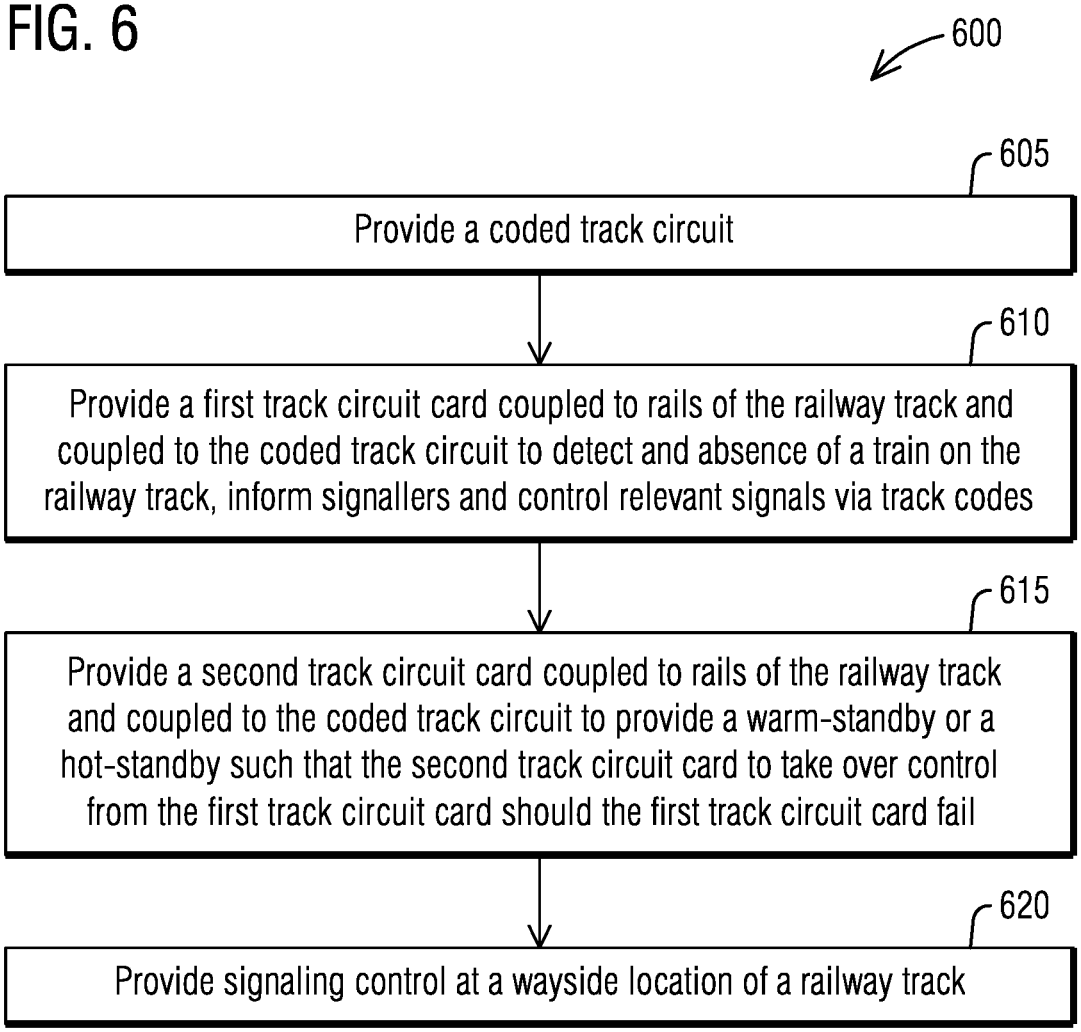
FIG. 6 illustrates a flow chart of a method of signaling control at a wayside location of a railway track according to an exemplary embodiment of the present invention.

As shown in FIG. 6, it illustrates a flow chart of a method 600 of signaling control at a wayside location of a railway track according to an exemplary embodiment of the present invention. Reference is made to the elements and features described in FIGS. 1-5. It should be appreciated that some steps are not required to be performed in any particular order, and that some steps are optional.

At step 605, the method 600 includes providing a coded track circuit with two track modules or cards. At step 610, the method 600 includes providing a first track circuit card coupled to rails of the railway track and coupled to the coded track circuit to detect an absence of a train on the railway track, inform signallers and control relevant signals via track codes.

At step 615, the method 600 includes providing a second track circuit card coupled to rails of the railway track and coupled to the coded track circuit to provide a warm-standby such that the second track circuit card to take over control from the first track circuit card should the first track circuit card fail. At step 620, the method 600 includes providing signaling control at a wayside location of a railway track.

The method 600 further comprises continually running online checks to verify that the second track circuit card is ready to take over control. The method 600 further comprises insulating the second track circuit card from the rails of the railway track by means of an air-gap provided by a relay. The method 600 further comprises providing a standby capability by the second track circuit card in an event the first track circuit card malfunctions.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A coded track circuit of a signaling control equipment to be located at a wayside location of a railway track, the coded track circuit comprising:

a first track circuit card coupled to rails of the railway track to detect an absence of a train on the railway track, inform signallers and control relevant signals via track codes; and a second track circuit card coupled to rails of the railway track, the second track circuit card is inactive but ready to provide a warm-standby or a hot-standby such that the second track circuit card to take over control from the first track circuit card should the first track circuit card fails, wherein the second track circuit card is configured to continually run online checks to verify that the second track circuit card is ready to take over control.

2. The coded track circuit of claim 1, wherein the second track circuit card is insulated from the rails of the railway track by means of an air-gap provided by a relay.

3. The coded track circuit of claim 1, wherein the first track circuit card transmits and receives signals on the coded track circuit for the purposes of communicating with the second track circuit card on the coded track circuit.

4. The coded track circuit of claim 1, wherein the first track circuit card determines a presence of a train via a shunting action of train axles based on received signal levels.

5. The coded track circuit of claim 1, further comprising:

a first relay to interface the first track circuit card to the coded track circuit being internal to the first track circuit card;

a second relay to interface the second track circuit card to the coded track circuit being internal to the second track circuit card.

6. The coded track circuit of claim 1, further comprising:

a standby logic to control a standby capability to achieve redundancy;

a first output connection of the first track circuit card;

a second output connection of the second track circuit card;

a relay connected to the first track circuit card and the second track circuit card such that the first output connection and the second output connection are in parallel, the standby logic coupled to the relay.

7. A coded track circuit of a signaling control equipment to be located at a wayside location of a railway track, the coded track circuit comprising:

a first track circuit card coupled to rails of the railway track to detect an absence of a train on the railway track, inform signallers and control relevant signals via track codes; and a second track circuit card coupled to rails of the railway track, the second track circuit card is inactive but ready to provide a warm-standby or a hot-standby such that the second track circuit card to take over control from the first track circuit card should the first track circuit card fails, wherein the second track circuit card to provide a standby capability in an event the first track circuit card malfunctions.

8. The coded track circuit of claim 7, wherein the second track circuit card is insulated from the rails of the railway track by means of an air-gap provided by a relay.

9. The coded track circuit of claim 7, wherein the first track circuit card transmits and receives signals on the coded track circuit for the purposes of communicating with the second track circuit card on the coded track circuit.

10. The coded track circuit of claim 7, wherein the first track circuit card determines a presence of a train via a shunting action of train axles based on received signal levels.

11. The coded track circuit of claim 7, further comprising:

a first relay to interface the first track circuit card to the coded track circuit being internal to the first track circuit card;

a second relay to interface the second track circuit card to the coded track circuit being internal to the second track circuit card.

12. The coded track circuit of claim 7, further comprising:

a standby logic to control a standby capability to achieve redundancy;

a first output connection of the first track circuit card;

a second output connection of the second track circuit card;

a relay connected to the first track circuit card and the second track circuit card such that the first output connection and the second output connection are in parallel, the standby logic coupled to the relay.

13. A track circuit system for use at a wayside location of a railway track, the track circuit system comprising:

a coded track circuit;

a first track circuit card coupled to rails of the railway track and coupled to the coded track circuit to detect an absence of a train on the railway track, inform signallers and control relevant signals via track codes; and a second track circuit card coupled to rails of the railway track and coupled to the coded track circuit to provide a warm-standby or a hot-standby such that the second track circuit card to take over control from the first track circuit card should the first track circuit card fail, wherein the second track circuit card is configured to continually run online checks to verify that the second track circuit card is ready to take over control.

14. The track circuit system of claim 13, wherein the second track circuit card is insulated from the rails of the railway track by means of an air-gap provided by a relay.

15. The track circuit system of claim 13, wherein the first track circuit card transmits and receives signals on the coded track circuit for the purposes of communicating with the second track circuit card on the coded track circuit.

16. The track circuit system of claim 13, wherein the first track circuit card determines a presence of a train via a shunting action of train axles based on received signal levels.

17. The track circuit system of claim 13, wherein the second track circuit card to provide a standby capability in an event the first track circuit card malfunctions.

18. The track circuit system of claim 13, further comprising:

a first relay to interface the first track circuit card to the coded track circuit being internal to the first track circuit card;

a second relay to interface the second track circuit card to the coded track circuit being internal to the second track circuit card.

19. The track circuit system of claim 13, further comprising:

a standby logic to control a standby capability to achieve redundancy;

a first output connection of the first track circuit card;

a second output connection of the second track circuit card;

a relay connected to the first track circuit card and the second track circuit card such that the first output connection and the second output connection are in parallel, the standby logic coupled to the relay.

* * * * *